US008827540B2

(12) United States Patent
Schafrinski et al.

(10) Patent No.: US 8,827,540 B2
(45) Date of Patent: Sep. 9, 2014

(54) MIXING DEVICE HAVING A BEARING FOR A RECEIVING DEVICE

(75) Inventors: Arne Schafrinski, Bad Oldesloe (DE); Judith Jacobs, Hamburg (DE)

(73) Assignee: Eppendorf AG, Hamburg (DE)

( * ) Notice: Subject to any disclaimer, the term of this patent is extended or adjusted under 35 U.S.C. 154(b) by 105 days.

(21) Appl. No.: 13/288,432

(22) Filed: Nov. 3, 2011

(65) Prior Publication Data

US 2012/0140589 A1 Jun. 7, 2012

Related U.S. Application Data

(60) Provisional application No. 61/409,742, filed on Nov. 3, 2010.

(30) Foreign Application Priority Data

Nov. 3, 2010 (EP) ..... 10014237

(51) Int. Cl.
*B01F 11/00* (2006.01)

(52) U.S. Cl.
USPC ..... 366/111; 366/215; 366/216; 366/218; 366/219

(58) Field of Classification Search
CPC . B01F 11/0017; B01F 11/0014; B01F 9/0025
USPC ..... 366/208, 215, 216, 200, 219, 108, 197, 366/218, 220, 111
See application file for complete search history.

(56) References Cited

U.S. PATENT DOCUMENTS

| | | | | | |
|---|---|---|---|---|---|
| 2,192,233 | A | * | 3/1940 | Mack | 366/111 |
| 3,706,443 | A | * | 12/1972 | Oberhauser | 366/216 |
| 3,891,191 | A | * | 6/1975 | Choules et al. | 366/111 |
| 4,109,319 | A | | 8/1978 | Brandt | |
| 4,305,668 | A | | 12/1981 | Bilbrey | |
| 4,750,845 | A | * | 6/1988 | Nabetani | 366/208 |
| 4,818,566 | A | * | 4/1989 | Taubenmann | 422/133 |
| 5,066,135 | A | * | 11/1991 | Meyer et al. | 366/208 |
| 5,171,539 | A | * | 12/1992 | Coombs | 366/209 |
| 5,238,304 | A | * | 8/1993 | Zimmermann | 366/219 |
| 5,372,425 | A | * | 12/1994 | Tannenbaum et al. | 366/208 |
| 5,409,312 | A | * | 4/1995 | Fletcher | 366/208 |

(Continued)

FOREIGN PATENT DOCUMENTS

| | | |
|---|---|---|
| DE | 18 16 710 | 6/1970 |
| DE | 102 32 202 | 2/2004 |

(Continued)

*Primary Examiner* — Walter D Griffin
*Assistant Examiner* — Anshu Bhatia
(74) *Attorney, Agent, or Firm* — White & Case LLP

(57) ABSTRACT

Disclosed is a mixing device for mixing, in particular, contents of laboratory vessels. The mixing device has a receiving device for receiving mixtures, a drive for setting the receiving device in a mixing movement relative to a chassis in which the receiving device moves on a closed path, and a bearing for guiding the receiving device in the mixing movement. The bearing has at least two supports, each with two bearing areas spaced apart from each other and having at least substantially no translatory and at least two rotational degrees of freedom. One bearing area bears the support at the chassis, and the other bearing area bears the receiving device at the support. The bearing has a guidance device, which guides the rotation of the receiving device relative to the chassis during the mixing movement.

16 Claims, 10 Drawing Sheets

(56) References Cited

U.S. PATENT DOCUMENTS

Figure 1:
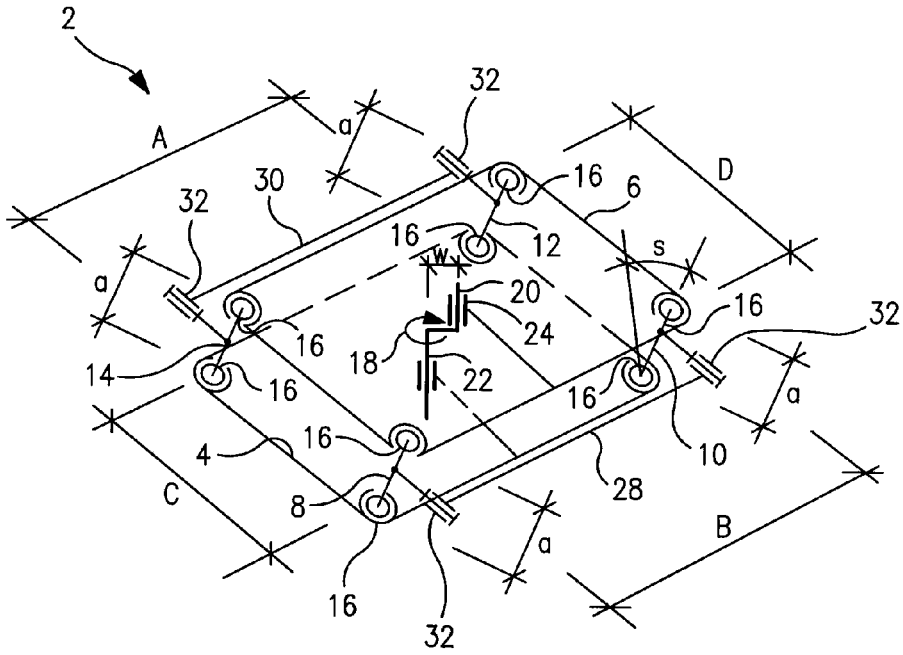

| | | | | |
|---|---|---|---|---|
| 5,639,160 | A * | 6/1997 | Kishimoto | 366/208 |
| 5,921,676 | A * | 7/1999 | Reynolds et al. | 366/208 |
| 6,190,032 | B1 * | 2/2001 | Choda | 366/208 |
| 7,338,199 | B2 * | 3/2008 | Hafner | 366/208 |
| 2006/0087911 | A1 * | 4/2006 | Herz et al. | 366/101 |
| 2007/0177457 | A1 | 8/2007 | Hafner | |
| 2009/0034363 | A1 * | 2/2009 | Frondorf et al. | 366/232 |
| 2010/0284238 | A1 | 11/2010 | Ebers et al. | |

FOREIGN PATENT DOCUMENTS

| | | |
|---|---|---|
| DE | 20 2006 001514 | 4/2006 |
| DE | 10 2007 010616 | 9/2008 |
| GB | 1 199 840 | 7/1970 |
| JP | 62 079838 | 4/1987 |

* cited by examiner

MIXING DEVICE HAVING A BEARING FOR A RECEIVING DEVICE

This application claims the priority benefit of U.S. Patent Application Ser. No. 61/409,742, filed 3 Nov. 2010.

The present invention relates to a mixing device, particularly for mixing the contents of laboratory vessels, having a receiving device for receiving mixtures, and having a drive by which the receiving device can be set in a mixing movement relative to a normally fixed position chassis, with which the receiving device moves on a closed path, returning periodically to a specific position in a specific alignment in space, preferably only translatorally and cyclically in a horizontal movement plane, in particular on a circular path, and having a bearing that guides the receiving device in the mixing movement.

Mixing devices in which contents of laboratory vessels are mixed, are well known. For this purpose, it is known that mixing devices have receiving devices for a wide variety of mixing vessels. Such receiving devices can also consist of a base structure on which a holder for the mixture vessel is held in an interchangeable manner, in order to make the mixer usable for different vessels. For laboratories, in particular, there are mixers that can also mix small quantities of fluid, so that small containers are combined in suitable holders, so-called "exchangeable block modules", also in very large groups of two, three or even four digit numbers. Such exchangeable block modules and also the reaction vessels can be standardized. There are, for example, reaction vessels with contents of 0.2 ml, 0.5 ml, 1.5 ml, and 2.0 ml—and in each case suitable standardized exchangeable block modules. Furthermore, there are exchangeable block modules for cryo vessels, Falcon vessels (1.5 ml and 50 ml), glass vessels, and glass beakers, for microtiter plates (MTP), deep well plates (DWP), slides (object plates) and for PCR plates with 96 or 384 individual vessels. This list is not comprehensive, but indicates the wide variety of existing laboratory vessels or mixing vessels for which the mixer should be suitable. For this purpose, the socket structure of exchangeable block modules can be standardized.

Because these exchangeable block modules can, in principle, be built so that the individual vessels can be inserted from above, a circular, translatory, cyclical mixing movement has been established for the known mixers which proceeds essentially in a horizontal plane. For this purpose, the known mixers generally have an electromotive eccentric drive that is responsible for moving a receiving device in this circular movement. The latter is mounted in known, different manners: for example, a mounting in linear roller bearings (so-called ball bearing bushes) or in linear glide bearings, in both horizontal directions, is known. A film hinge mounting or mounting in an oscillating frame, in which the receiving device is mounted in a frame resiliently in the two horizontal directions, for example, using coil springs, is also known.

These known types of mountings/bearings all have different disadvantages. The mounting in linear roller bearings or linear glide bearings is constructively complex, requiring an exact alignment, and can therefore be prone to failure. The film hinge mounting is inexpensive and constructively quite simple, however, it can lead to fatigue failure. The use of an oscillating frame leads to an increased axial loading of the drive, and requires a specific construction height. Furthermore, the drive must perform additional work due to the spring elements used in the oscillating frame. This also increases the risk that an oscillating frame can be damaged. In addition, the alignment of an oscillating frame with respect to the eccentric drive in a mixer is very complex.

Typically such mixers are driven with a rotational frequency of 200 rpm to 1,500 rpm. The frequency of the mixing movement can be adjusted, as is known, depending on the mixing required for the mixture, but also depending on the mix-mechanical parameters.

The physical problem of imbalance results from the mixing movement, particularly from the described, preferred circular mixing movement. This is solved, as is known, by a suitably placed counter weight, which is connected to the rotationally driven receiving adapter and rotates with it for compensating the imbalance.

Similarly, the documents DE 20018633U1 and U.S. Pat. No. 5,655,836 describe known mountings with which the receiving device stands on supports in the shape of a "table" with joint bearings at both ends, where all supports are equidistant from each other. This has been problematic in that the mixing forces that are possible in this arrangement and that act under the influence of the dynamic of the mixing movement permit also an undesired torsion and/or tipping of the table with respect to a (normally fixed) chassis (Z-stroke), wherein the main plane of the receiving device (and with it, also the mixture vessels contained in it) can move significantly out of the horizontal plane—which leads to the danger that vessel contents are spilled and the undesired torsion and/or tipping of the receiving device cannot be restored by the drive.

The document DE 102 32 202 also discloses a generic mixing device for the contents of laboratory vessels with a supports comprising bearings. This device has no cross-linking element like a web which connects and guides the supports. Therefore such a device bears the risk that its supports carrying the receiving device twist and an undesired torsion occurs.

The objective of the present invention is to create a mixing device having a bearing that avoids or at least reduces the known problems from the prior art. In particular, the present invention has the objective to provide a mixer with joint bearings in which the danger of the undesired torsion and/or tipping of the receiving device is reduced. In addition, the fields of application of the prior mixing devices are to be expanded.

The objective is solved by a device for mixing as described herein. Preferred embodiments are also described.

According to the invention, a mixing device, in particular for mixing the contents of laboratory vessels, has a receiving device for receiving mixtures, a drive and a bearing. The drive can set the receiving device, in a mixing movement relative to a normally fixed chassis, guided by the bearing.

Preferably, the mixing movement is a translatory movement of the entire receiving device (driven by the drive and guided by the forced guidance of the bearing) on a path in space which proceeds substantially in the horizontal plane, i.e., in the X and Y direction in a three dimensional coordinate system. The maximum deviation of the path in the vertical (that is orthogonal to the horizontal plane) direction (Z direction) preferably amounts to 5% of the height (in the vertical direction) of the smallest mixing vessel used, more preferably 1%, and particularly preferably 0.2% of the height of the smallest mixing vessel used. Deviations in the vertical direction from the horizontal plane preferably amount to no more than 0.2 mm, more preferably to no more than 0.05 mm, and particularly preferably to no more than 0.02 mm. Accelerometers that measure the acceleration of the receiving device in all three spatial directions (X, Y, Z) are used for evaluating the quality of a circular path that is as planar as possible. The value of the acceleration vectors should always be constant for a given rotational frequency, wherein the Z component is to be small as possible, and the X and Z components are phase shifted to each other. At a rotational frequency of 3,000 rpm, the effective value for the acceleration vector in the Z direction is preferably less than or equal to 50 $m/s^2$, particularly less than or equal to 20 $m/s^2$, and particularly preferably less than or equal to 10 $m/s^2$, wherein this value also depends on the weight load of the mixing device. For example, with 3,000 rpm, the effective value amounts to 10 $m/s^2$, if the mixing device carries an exchangeable block module with a weight of 500 g as a receiving device. A uniaxial sensor (M352C65, M353B15) from PCP Piezoelectronics, Inc was used for detecting the acceleration in the Z direction. In addition, a triaxial sensor (356A22) from PCP Piezoelectronics, Inc. was used to determine the quality, i.e. uniformity, of the concentricity, i.e. the acceleration.

Generally speaking, the mixing movement is a movement of the receiving device on a closed, as it were, ring-shaped, also somewhat spatially three dimensional running path which is at least predominantly translatory, but also can perform rocking motions, if they return at least periodically to at least one specific position in a specific alignment in space. Actually, the receiving device preferably returns to each point in space of the path, and it is a periodic movement, so that each point in space of the path is always reached at uniform time intervals—or in other words, so that the receiving device is periodically located at the same location. The preferred circular or elliptical, planar path is also designated as an orbital path. The preferred circular movement path of the inventive mixing device represented in the three dimensional coordinate system lies predominantly on the horizontal plane spanned by the X (abscissa) and Y (ordinate) axes. Movements in the direction of the Z axis (applicate) are preferably less distinct and arise during the mixing movement as a type of up and down movement of the receiving device, and with it, also the vessels and their content located therein. The movement in the direction of the Z-axis is designated at a Z-stroke.

The inventive bearing retains and guides the receiving device during this mixing movement so that the dynamic up and down movement of the receiving device is preferably reduced as much as possible. This dynamic up and down movement is known to the person skilled in the art as a Z-stroke, as already mentioned. A Z-stroke during the mixing movement is disadvantageous in most application cases, and therefore undesired, because it can lead to wetting, and with it to contamination of the vessel cover, or in the case of open vessels, the sample can splash out of the vessel.

The bearing has at least two supports. The at least two supports can have the same length, or alternatively, different lengths. In the case of supports of different lengths, the height must be compensated using the other components, for example the receiving device or the chassis, in order to align the receiving device again in a horizontal plane. Each of the inventive supports has at least two bearing areas (joint bearing) spaced apart from each other, which have—at least substantially—no translatory and at least two (linearly independent) rotational degrees of freedom. Bearing areas (joint bearing) are the areas of the support that are in direct contact with a bearing or parts of a bearing. A support can be one-piece or also can be multi-part. In the case of multi-part supports, at least two parts each have at least one bearing area. The at least two bearing areas of a support can be located at different positions of the support. The terminal arrangement in which a bearing is located at each of the two ends of the support is preferred because this simplifies the assembly of the inventive mixing device. The bearing areas preferably have sliding bearings each of which has at least one rotational degrees of freedom about an axis, which deviates from the direction of extension of the support (normally approximately the vertical). Preferably the axes of rotation are orthogonal to the direction of extension.

According to the invention, it is possible to implement the (at least) two rotational degrees of freedom by two separate bearings. Preferably, however, the bearing area has only one bearing. This can implement all three rotational degrees of freedom (X, Y, and Z), preferably even with axes (ball joint) intersecting at one point (center of rotation). Or in another preferred embodiment, the directions of the one rotational degree of freedom of both bearings of the respective bearing area are perpendicular to each other—preferably even crossing at a point (center of rotation) (universal joint or "Cardan joint"). In another possible embodiment, the directions of the one rotational degree of freedom of both bearings lie in the horizontal.

The bearings have at least substantially no translatory degree of freedom, i.e., to a person skilled in the art this means a bearing without translatory degrees of freedom, wherein he accepts deviations in the typical tolerance range. These unwanted deviations can result, for example, from the elastic and/or plastic deformation of the elements of the bearings that however, due to the material selection should be negligible; elastic and/or plastic deformations are not desirable, as long as elastic bearing elements are not used explicitly.

Of these bearing areas, one mounts the respective support at the chassis, and the other mounts the receiving element at the support. Bearing areas (joint bearing) in the sense of this invention is preferably a Cardan joint or particularly preferably a ball-socket joint (ball joint). A support provided with the ball joint is called a ball support here. The bearing area can however be a short elastic rod section, for example, in which the bending elasticity constitutes the two rotational degrees of freedom (which are then limited however in their extent of movement, for example, by the plastic deformation limits or breaking strength of the bar).

The bearing according to the invention has a guidance device, which during the mixing movement guides the rotation of the receiving device relative to the chassis.

Due to this guidance device, which is preferably form-locking, an unintended, in particular, chaotic rotation of the receiving device relative to the chassis is effectively prevented.

The drive of the inventive mixing device initially is in the position to set the receiving device in a mixing movement, which as mentioned, proceeds preferably circularly, translatorally, and cyclically in one plane. "Circular, translatory, cyclical" can be described in other words in that with one such inventive mixing movement all points of the receiving device perform a repeating circular movement with essentially the same radius, at the same angular speed and the same angular position about a respective center point in a flat parallel plane. The mixing movement proceeds preferably in substantially horizontal planes—so that for example exchangeable block module with reaction vessels received standing upright, received in receiving adapters of the receiving device are mixed reliably, i.e., without the contents of the vessels spilling in the case of typical filling. The drive occurs preferably using a cam, which is mounted in the receiving device in a manner so as to rotate. Here, the offset between the axis of the drive shaft and the axis of the cam parallel to it determines the circular path radius of the mixing movement. This offset, which is also designated as the amplitude of the cam, specifies the incline of the supports, in the case of support lengths remaining equal, and with it also the distance between the receiving device and the chassis. The relationship of the components can be such that any weight acting on the receiving device is transferred to the chassis only by the supports and not by the drive.

The inventive bearing of the receiving device makes a form-locking guidance of the receiving device possible, wherein the bearing is simple to assemble, and nonetheless, the axial forces that originate from the receiving device are absorbed by the bearing. Furthermore, the inventive bearing makes it possible to design mixers having low construction heights. The advantages of the inventive bearing are therefore simple assembly and very significant reduction of the loading of the drive in the axial direction. The latter point increases the operational safety and service life of the drive. Thus, the inventive bearing is particularly suited also for use in mixing devices, which have to bear heavy loads, for example (e.g., large Erlenmeyer flasks (2000 ml)). Because space in a laboratory is always limited, the low construction height of the invention mixer is also advantageous.

Furthermore, this bearing enables already in principle the radius of the circular path to be set by determining geometric parameters such as the support length, or even to make the device adjustable by the user. The radius of the circular path preferably amounts to between 0.5 mm and 5 mm, and particularly preferably between 1 mm and 2 mm. The circular path frequency can be reduced due to the new bearing to values of 50 rpm. However, frequencies of 2,000 rpm, preferably 2,500 rpm, and even 3,000 rpm (particularly in the case of heavy loading weight of the vessels) can also be used.

Preferably, the bearing has two, three or four of the supports which support the receiving device, as a matter of principle in the manner of stool legs or table legs, for example, as a table top on the chassis as a subsurface, as it were. If, for example, the joint bearings, in particular, the centers of rotation of the joint bearings of a support are at the same distance from each other as the joint bearings, in particular the centers of rotation of joint bearings of all other supports, this always results in a mobility of the receiving device in a plane parallel direction above the chassis (mobility of the plane by the receiving device-joint bearing with respect to the plane by the chassis joint bearing). Because the supports carry the axial/vertical loads, a mixing device is more loadable, the more supports it has.

If the distance between chassis and receiving device is determined, for example by suitable forced guidance, this transitory mobility for example in the case of equal length parallel supports, consists only of a circular path with a fixed radius. This is essential in order to attain a uniform mixing movement on a circular planar path, i.e., a stable mixing movement without tipping and with reduced Z-stroke.

With this inventive mixing device, the inclination of each individual support relative to the chassis remains constant over the entire cycle of the mixing movement, because the supports cannot twist against each other. In addition, in the case of an inventive mixing device having supports of equal length, where the imaginary points a, b, c, d, . . . , etc. are distributed over the entire length, it holds that also during the mixing procedure the distance between one of these points and one of the respective equivalent points a', b', c', d', . . . , etc, on one of the other supports remains constant. Without these features, an undesired torsion of the two planes with respect to each other would occur.

As a consequence, the determination of the distance represents a first example of an inventive guidance device that guides the rotation of the receiving device relative to the chassis during the mixing movement. The distance (and thus, also the radius of the circular path) is ultimately specified by the amplitude with which the cam of the receiving device moves relative to the chassis, wherein the cam is mounted at the chassis. Even the distance of the movement plane of the receiving device from the chassis is designed to be adjustable, the radius of the circular path of the mixing movement at the inventive mixing device can be adjusted this way, for example.

Even when the distance from the chassis plane to the receiving device is determined by the drive shaft at the engagement point of the drive shaft—i.e, by the cam—at the receiving device, a change of the distance by an undesired tipping of the receiving device relative to the chassis about the engagement point is possible in the remaining points.

However, with the inventive mixing device the distance between chassis plane and receiving device at the remaining points remains unchanged. The distance remains unchanged at all points because the inclination of each individual support relative to the chassis remains constant over the entire cycle of the mixing movement, and the supports cannot twist with respect to each other. This feature—inclination of each individual support relative to the chassis remaining the same—excludes an undesired torsion of the two planes, namely the movement plane of the receiving device (the plane through the receiving device-joint bearing) with respect to the chassis plane (plane through the chassis joint bearing). This torsion is undesired, and the present invention aims to minimize it, because it leads to an uncontrollable mixing movement, which is the disadvantageous (Z-stroke).

This undesired torsion is reduced or prevented due to the inventive guidance device. During the mixing movement, the inventive guidance device guides the torsion of the receiving device relative to the chassis, wherein the reduction/prevention of this undesired torsion falls under the inventive guidance of the torsion. The inventive guidance device is preferably guided so that in the process the undesired torsion is equal to zero. Represented as projections in the X, Y, Z planes, it can be recognized that the guidance device causes the supports to always travel in the same direction, i.e., the guidance device synchronizes the support movement.

Inventive guidance devices are, for example, bearings, connecting rods, cams, rails, webs, slotted links and combinations thereof. The inventive guidance device can also be composed of a magnetic field. In this design, the receiving device as well as the chassis each carry at least one compatible magnetic element, i.e., elements in an attractive interaction, selected from the group of magnets, elements that can be magnetized, permanent magnets, electromagnets, and current bearing coils, or a combination thereof. Permanent magnets, for example, are composed of a ferromagnetic material, such as iron, nickel, cobalt, neodymium-iron-boron, or samarium-cobalt.

The development of a magnetic field between the receiving device or parts thereof, and the chassis, or parts thereof, achieves a forced guidance so that the inclination of each individual support relative to the chassis remains constant over the entire cycle of the mixing movement. An adjustable design is possible, for example, by regulating the currents in a coil bearing current by means of a control device. The control device regulates the current flow based on signals received (e.g., manual entry relating to the current density, the weight, and/or the viscosity of the vessel contents, sensor signals relating to the detected weight and/or the viscosity), and thus the strength of the magnetic field, or regulates the poles of the coil and thus the direction of the magnetic field. Thus it is possible to attain, depending on the weight, vessel, and/or vessel contents, to achieve a targeted movement of the receiving device in the vertical direction, i.e., a shaking movement (up and down movement; vibration), which continues to move along its circular path. This is an advantage of this design.

Preferably the guidance device has at least one web which connects two of the inventive supports together. Here, a bearing that has no translatory degree of freedom and only one rotational degree of freedom, (hinge joint) supports the web at one support, and a second hinge joint supports the web at the other support. In this, the two hinge joints can rotate about each other in parallel axes. Thus, the orientation of these two supports is determined in the plane which is oriented at a right angle to the two parallel hinge joint axes: the supports can twist with respect to each other only in this plane. Therefore, a 3-dimensional ("warped") torsion (twisting) of the two supports with respect to each other is blocked in principle by means of the web. A warped torsion (twisting) of the supports with respect to each other is however a precondition for the undesired torsion of the two planes supported by the supports (as already indicated above: with torsion of the two planes with respect to each other, the incline of the supports simultaneously changes the distance between the planes). The undesired torsion of the planes with respect to each other is accordingly significantly reduced by the inventive guidance device, the web arranged on the supports in interaction with the hinge joints. It is known to the person skilled in that art that compressions and elongations of the supports and webs cannot be completely excluded, which also causes an undesired torsion. The axes of the hinge joints are each supported centrally between the respective joint bearings of the two supports connected by web. This applies in particular also for two supports of different length which are connected together using a web and hinge joints. With a device having a plurality of supports, with four for example, in which every two supports have the same length, it does not matter between which of the supports the web with hinge joints is disposed, as long as the axes of the hinge joints are each disposed centrally between the respective joint bearings.

In order to illustrate that no undesired torsion results from the mounting of the webs via the two hinge joints at, for example, two equal length parallel supports, the system can also be described as follows: an imaginary straight line (that is, a straight line that is projected for improved clarity, but does not actually exist), a so-called connecting straight line, which begins at one of the two parallel hinge joint axes and proceeds at a right angle to the two hinge joint axes, remains always, even during the mixing movement, parallel to an imaginary connecting straight line (that is a straight line that is projected for improved clarity but does not actually exist), which connects the two bearing joints together at the chassis, and to an imaginary connecting line (that is a straight line that is projected for improved clarity but does not actually exist), which connects the two bearing joints together at the receiving device.

Preferably, the following distances at the inventive device are of equal size: between two supports the distance of the centers of rotation of the joint bearings on the chassis from each other, and the distance of the centers of rotation of the joint bearings on the receiving device from each other. With also equal distances between the centers of rotation at the one support and the centers of rotation at the other support, i.e., with supports of equal length, a parallelogram shaped arrangement of by these centers of rotation results with the inventive bearing. When preferably at all supports of the device, the centers of rotation of the joint bearings of two supports at the chassis and the centers of rotation of the joint bearings of the same two supports at the receiving device are equidistant from each other, and when all centers of rotation at the chassis have the same arrangement to each other as the centers of rotation at the receiving device, a parallelogram shaped arrangement of the centers of rotation always results at every two supports to each other—and from this, a bearing of the inventive mixing device that is guided in a form locked manner. This is even forcibly guided when, for example as already described above, the movement plane of the receiving device is determined at a specific distance from the chassis by suitable additional mounting.

Preferably the inventive supports have a length between 700 mm and 5 mm; preferably a length of 300 mm to 10 mm; and particularly preferably a length of 150 mm to 20 mm. In one inventive design of the supports with joint bearings, the supports have a length of 35 mm, measured from the center of rotation/center point of the ball of the ball-socket joint. Then the joint bearings, designed as a ball-socket joint, have a ball diameter between 60 mm and 3 mm, preferably a ball diameter between 30 mm and 5 mm, and particularly preferably a ball diameter between 20 mm and 7 mm. In one inventive design of the ball-socket joint, the ball diameter amounts to 13 mm. From this, a preferred glide speed results in the joint of between 0 and 0.2 m/s with the pairing of metal/plastic and also in the case of the reversed material selection—advantageous in particular, when the ball has at least its joint surface composed of polished metal such as high yield austentic steel or aluminum (anodized) or of ceramic, and the socket has at least its joint surface composed of plastic such as abrasion resistant, glide modified Thermoplast or Duroplast. The preferred glide speed can also be attained using the reversed material selection, i.e. the ball is composed at least at its surface of a plastic, particularly an abrasion resistant glide modified Thermoplast or Duroplast, and the socket, at least at its joint surface, is composed of a polished metal, such as high yield austentic steel or aluminum (anodized) or of a ceramic.

In the case of the joint bearing designed as a ball-socket joint more variants can be distinguished. In one variant, the ball is rigidly connected to the support, and the socket is connected with the support only indirectly via the ball. In a second variant, the arrangement is reversed, i.e., the socket is rigidly connected to the support, and the ball is now connected to the support in via the socket. The part of the ball-socket joint that depending on the variant is only indirectly connected to the support, is in contrast in rigid contact with the chassis or receiving device. The second variant is preferred, because an inventive mixing device with this arrangement of the bearing is particularly simple to assemble.

The inventive mixing device can, in addition to the receiving device, the drive and the inventive bearing, comprise also at least one heating element, preferable a controllable heating element. This is preferably implemented by a Peltier element or a resistance heating element, e.g., a heating film. In one preferred embodiment, the mixing device comprises additionally a cooling device, e.g., a Peltier element with a heat sink. In a particularly preferred embodiment, this can be used for heating and cooling, i.e. thermostating. In the case of different temperature conditioning devices, e.g., with the use of a Peltier element, the supplemental use of a cooling bodies and fans is expedient. The heating or cooling element changes the temperature of the laboratory vessel, and with it, also of the temperature of the contents located therein.

The inventive mixing device can be operated with a method for mixing the contents of laboratory vessels. Here, a laboratory vessel with contents is placed on the mixing device, and then the mixing device is placed into operation. With the mixing method it is also possible to change the temperature of the content, i.e., to set to a temperature using controlled heating and cooling. Thus, a simultaneous mixing and temperature change is possible using the inventive device.

The inventive mixing device has different uses: on the one hand, it can be used as a free-standing (stand alone) mixing device, i.e., in a laboratory as a single independent piece of laboratory equipment. A further application is its use in an automated laboratory equipment, such as a laboratory work station, which, for example performs various sample preparation steps, including mixing and optionally as well the final analysis in further work steps. A further possible use is in an incubator in which samples, particularly live cells, are placed in a controlled atmosphere (temperature, moisture, gas), wherein the inventive mixing device assures uniform movement of the samples to be incubated.

The following advantages arise from the prior brief description of the inventive device: simple assembly of the bearing and reduction of the loading (weight strain) of the drive in the axial/vertical direction. A further advantage results from the high load capacity of the bearing, as well as from the broad bandwidth of possible rotational speeds (50 rpm-3,000 rpm), in the suitability of the bearing for both small, lightweight laboratory vessels, e.g., Eppendorf reaction vessels microtiter plates, slides, which all can be filled with the smallest volumes (maximum filling volumes 0.1 ml, 0.2 ml, 0.5 ml, 1.5 ml, and 2.0 ml), as well as for large, heavy filled laboratory vessels, Falcon tubes, glass vessels, Erlenmeyer flasks, (e.g., up to 2,000 ml) beaker glasses, etc. All these advantages make the present inventive device suitable as a stand-alone (free-standing) mixing device on a work bench in a laboratory. It is equally suitable to be used in a laboratory automate or an incubator.

These and other advantages and features of the present invention are described in the following with reference to the enclosed figures which illustrate the exemplary embodiments of the invention.

Figure 2:
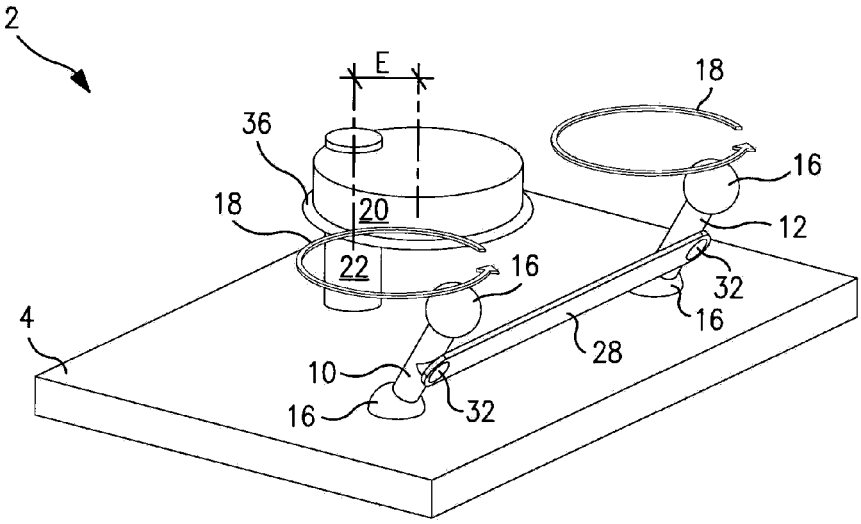
Figure 3A:
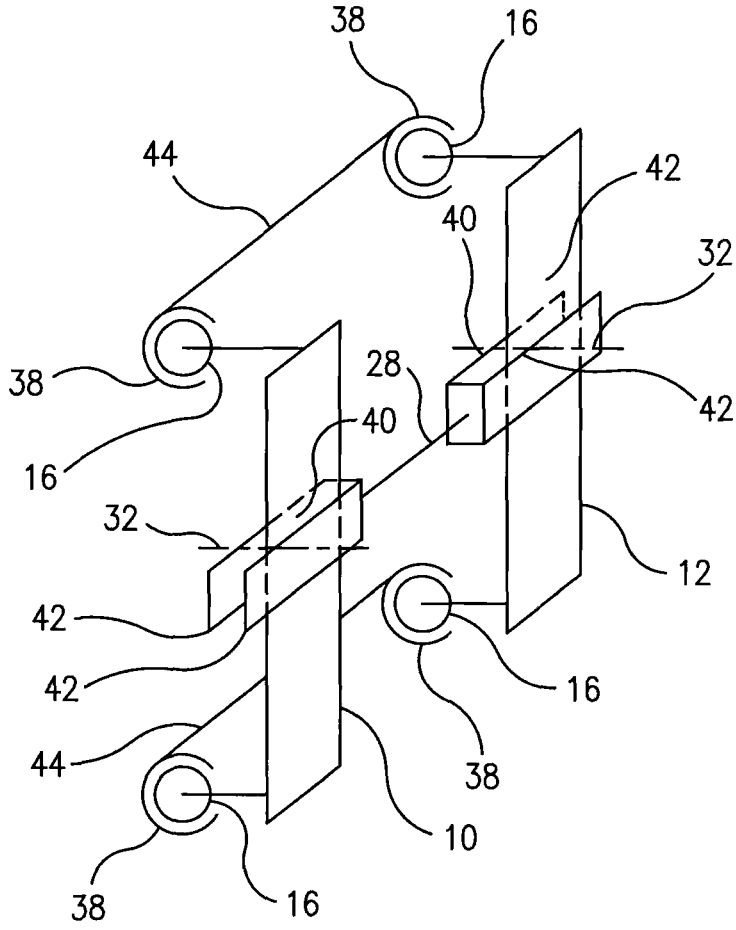
Figure 3B:
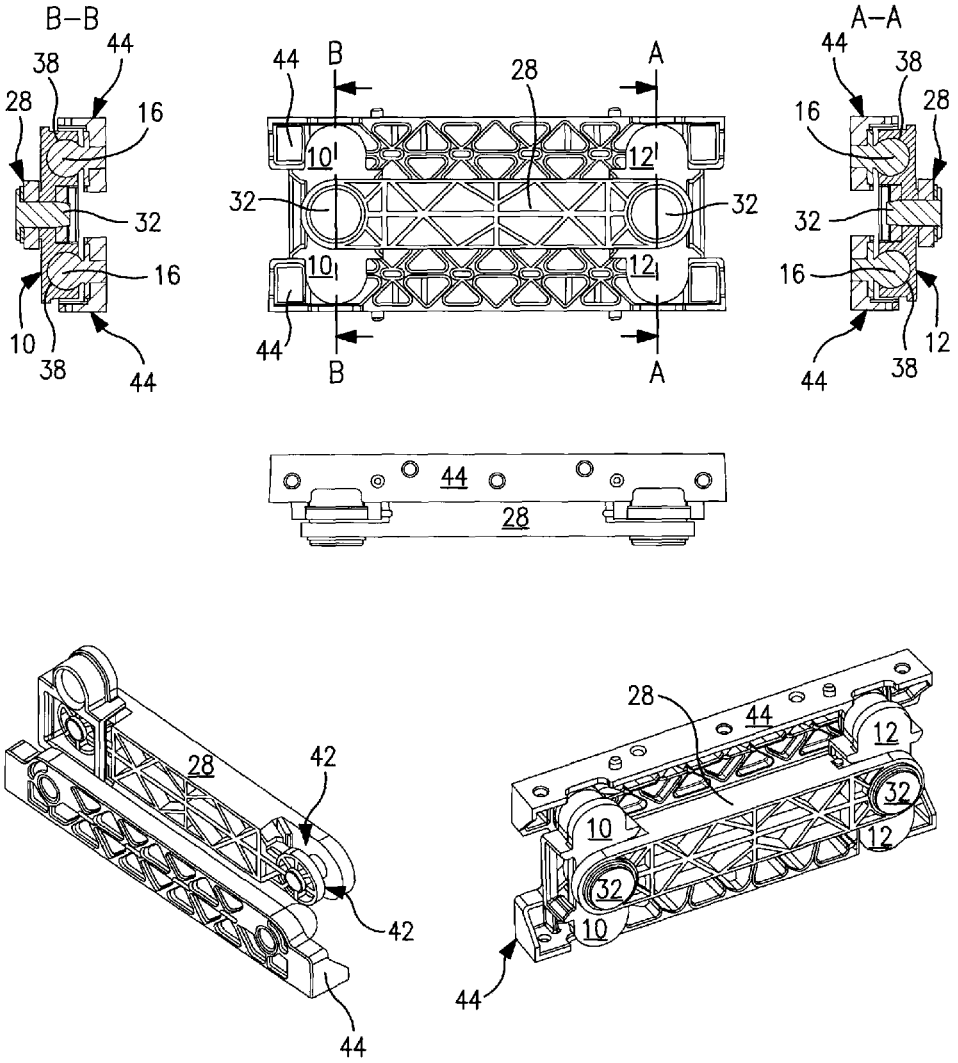
Figure 3C:
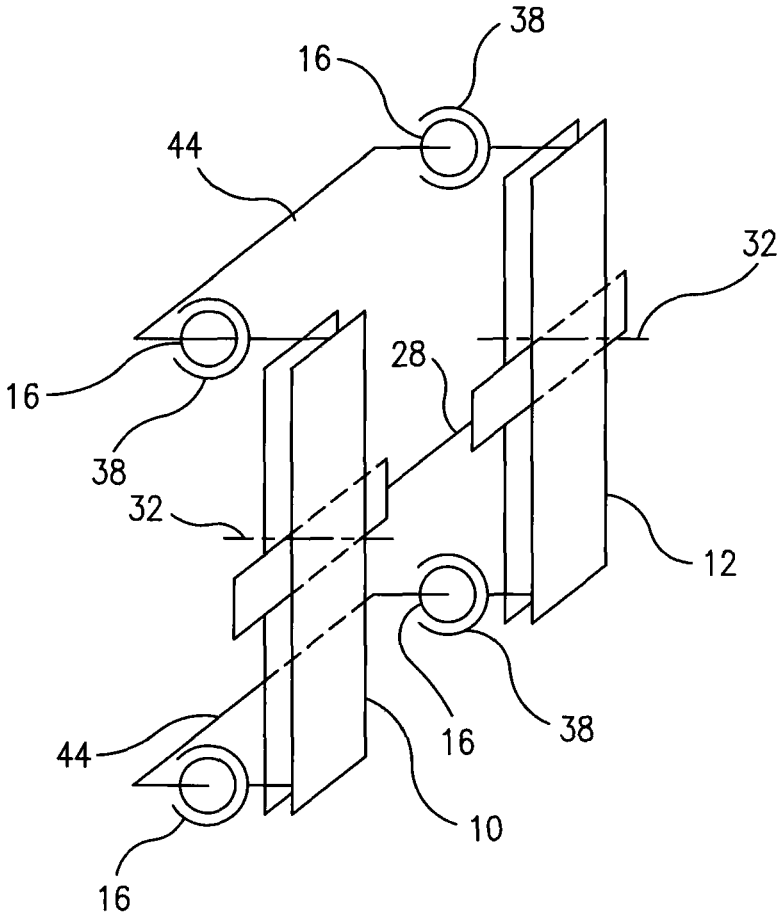
Figure 3D:
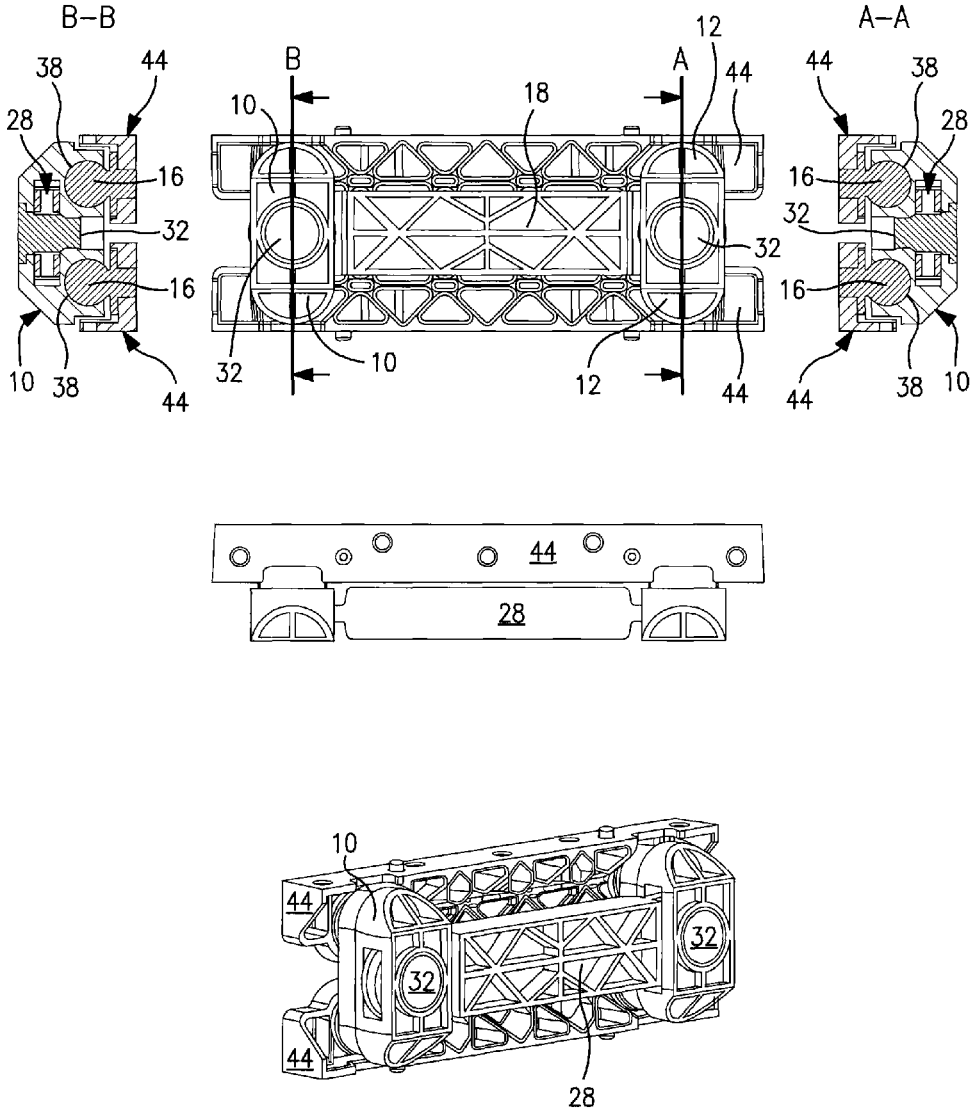

FIG. 1 shows a schematic spatial view of an inventive device for mixing,

FIG. 2 shows a schematic spatial view of an alternative inventive device for mixing without a receiving device, FIG. 3 *a* shows a schematic spatial view of a design of an assembly of an inventive bearing, in which the web encompasses the ball support on which it is supported at the hinge joint in a fork-shape, and in which the balls of the ball-socket joints are disposed at the ball supports, FIG. 3 *b* shows a schematic spatial view of a physical design of the inventive bearing according to FIG. 3 *a,*

FIG. 3 *c* shows a schematic spatial view of a design of an alternative design of the assembly according to FIG. 3, in which the ball support encompass the web in a fork-like manner at the hinge joint, and in which the ball-socket joints are disposed at the ball supports, FIG. 3 *d* shows a schematic spatial view of a physical design of an inventive bearing according to FIG. 3 *c,*

Figure 4:
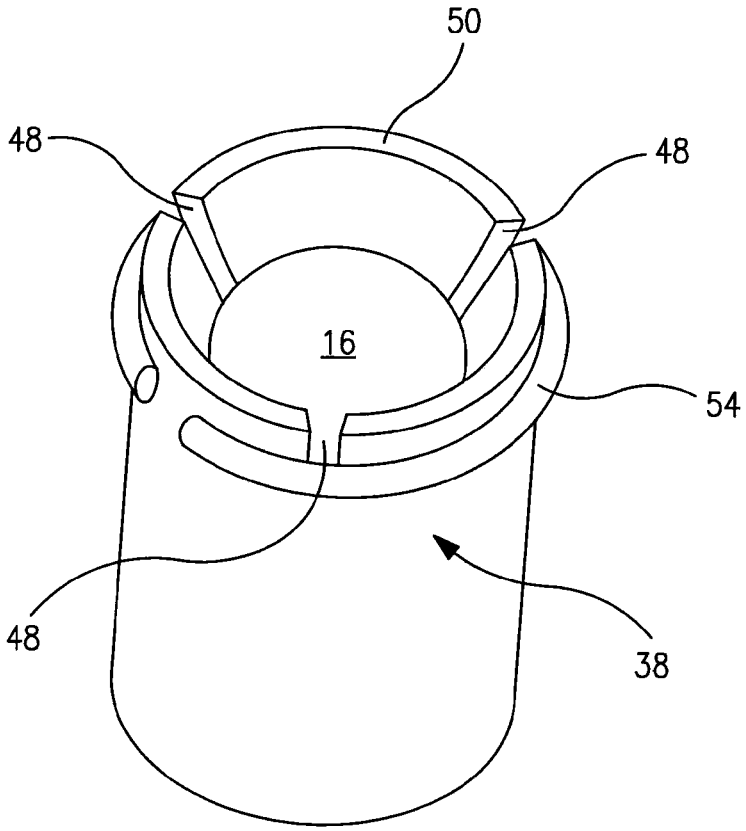
Figure 5B:
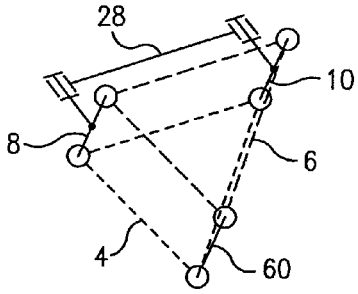
Figure 5A:
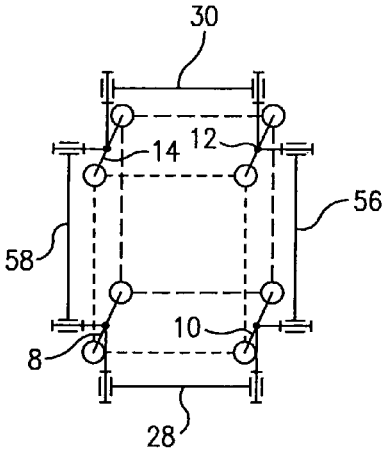
Figure 5C:
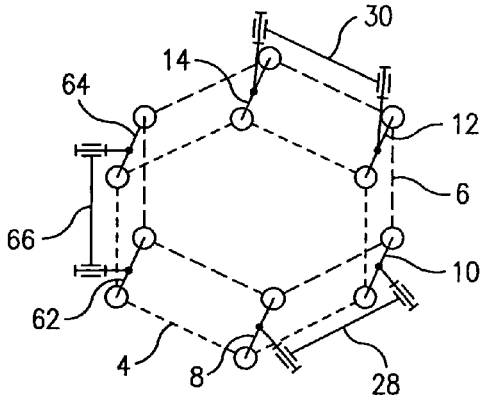
Figure 6:
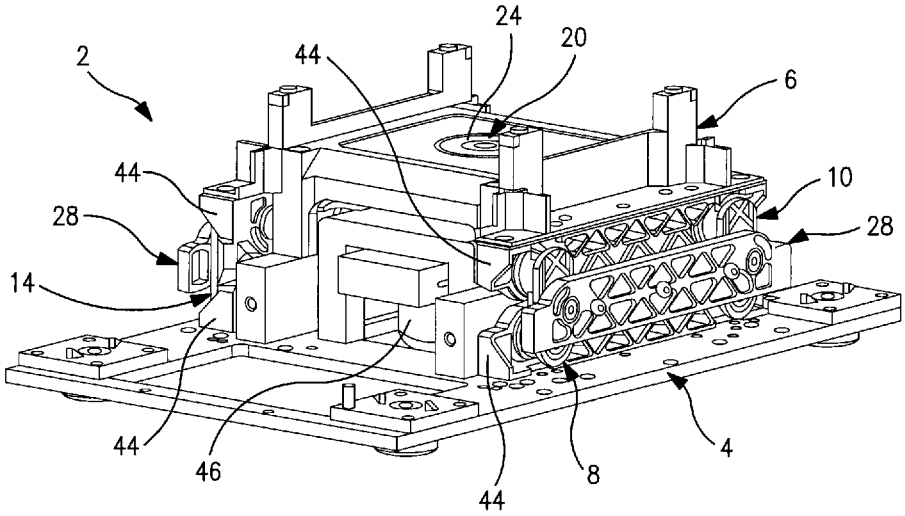
Figure 7:
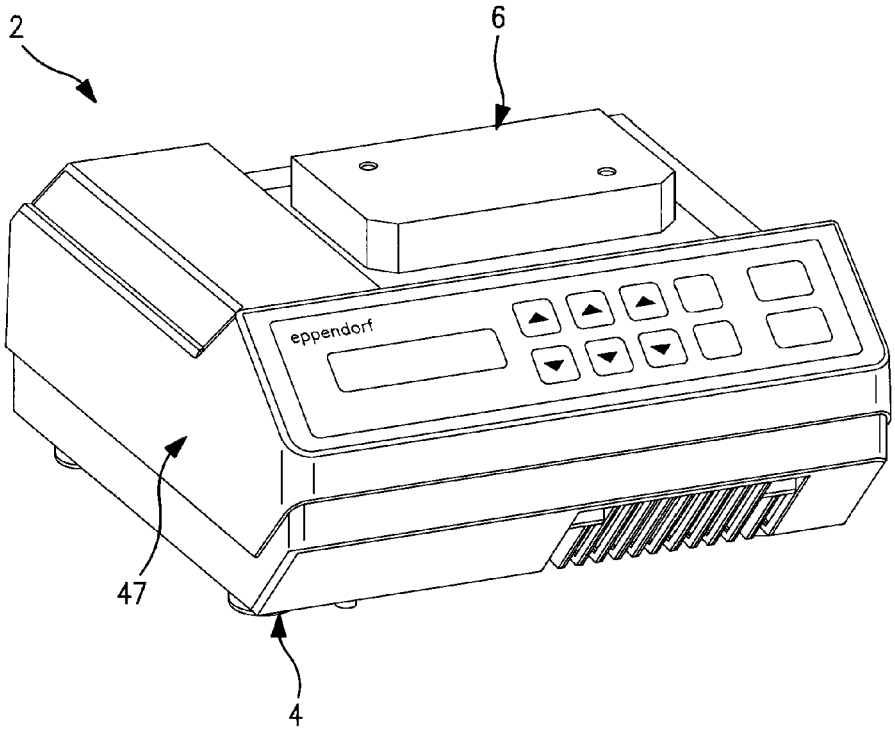

FIG. 4 shows a schematic spatial view of a design of an inventive joint bearing, FIGS. 5 *a, b* and *c* show several schematic spatial views of alternative arrangements of the inventive ball supports of a device for mixing according to FIG. 1, in which the ball supports are connected pairwise together differently by webs, FIG. 6 shows a schematic spatial view of a physical design of an inventive device for mixing, FIG. 7 shows a schematic spatial view of a physical design of an inventive device according to FIG. 6 as a exterior representation with a housing, and In the different figures, construction elements somehow corresponding to each other are provided with the same reference numbers.

A mixing device 2 can be seen in FIG. 1 having a chassis 4 and a receiving device 6, which are each depicted only schematically as rectangular plates. As seen in the spatial view, the receiving device 6 is supported on four supports 8, 10, 12, 14. The supports have a (not shown here) cylindrical basic shape, each with a joint ball 16 of a respective joint bearing at both ends of the respective support. Each of the joint balls 16 is disposed in a ball socket in the bottom of the receiving device 6 or in the top of the chassis 4. The centers of rotation (center points) of the bearing balls are equidistant from each other at all supports (distance a).

It can be recognized in FIG. 1 that the centers of rotation (center points) of the joint bearings 16 of the supports 8 and 10, and the supports 12 and 14 in the chassis 4 have the same distance A as the distance B between the centers of rotation (center points) of the joint bearings 16 of the same two supports 8 and 10, and the supports 12 and 14 in the receiving device 6. The same applies for the distances C and D between the centers of rotation (center points) of the joint bearings 16 of the supports 10 and 12 as well as the supports 8 and 14. Thus, in the device 2 according to FIG. 1, a parallelogram shaped arrangement of the respective four centers of rotation (center points) is given between any pair of the four supports 8, 10, 12, and 14.

As can be seen in FIG. 1, the four centers of rotation (center points) of the bearing balls 16 at the upper ends of the four supports are disposed on a (horizontal) plane 6, and the four centers of rotation (center points) of the bearing balls 16 at the respective lower ends of the four supports are disposed on a (horizontal) plane 4 plane parallel to it. This inventive bearing permits a translatory, circular, cyclical mixing movement of the receiving device 6 along the arrow 18.

The receiving device 6 in this mixing movement 18 is driven by a cam 20, which sits on a vertical rotationally driven shaft 22. The cam 20 is mounted on slide bearings in a through hole 24 in the receiving device 6, and determines the radius of the rotational movement 18 with its eccentricity E between the cam axis and the shaft axis. This determines through the form locking of the joint bearing 16—so long as the bearing play and tolerances remain unconsidered, that is, in principle—then also the distance between the chassis 4 and the receiving device 6 (perpendicular to the movement plane of the mixing movement 18).

It can be seen in FIG. 1 that the joint bearings 16 permit such a pivoting angle S of the support (for example 10) with respect to the receiving device 6 (and therefore, also with respect to the chassis 4), that with the mixing movement 18 the circular paths of the centers of rotation of the joint bearings 16, which bear the receiving device 6 at the support (for example 10), are approximately equal in the top view on the movement plane 18 (top view not shown).

It can further be seen in FIG. 1 that the supports 8 and 10 are connected together by a web 28, and the supports 12 and 14 are connected together by a web 30. At both ends of the web 28, a hinge joint 32 bears the respective web at one of the supports 8, 10, 12, or 14. The hinge joints 32 bear the respective web 28, 30 at the respective support so as to rotate about axes 34 that are parallel to each other. Thus, the axis of rotation of the hinge joint 32 at the left end of the web 28 in FIG. 1, for example, is parallel to the axis of rotation of the hinge joint 32 on the right end of the web 28 in FIG. 1.

Each web 28, 32, hinged at the ball supports 8 to 14 so as to rotate about the two parallel axes at its two ends is a guidance device, which during the mixing movement 18 guides the rotation of the receiving device 6 relative to the chassis 4 such that this rotation during the entire duration of the period of a recurrence—thus, during the entire mixing movement 18—is equal to zero (in other words, is always translatory).

FIG. 2 shows an alternative design of an inventive mixing device 2. In FIG. 2 the design elements of the device 2 that correspond to each other are identically numbered as in FIG. 1, also if they are not identical, but rather are only functionally corresponding design elements.

In contrast to the device 2 according to FIG. 1, the device 2 according to FIG. 2 has only two supports 10, 12. Here the (vertical) distance of the receiving device 6 (not shown) from the chassis 4 is determined by a horizontal collar 36 at the lower end of the cam 20.

FIG. 3 *a* and *b* show a possible design of an inventive bearing, which is shown in principle in FIG. 2. In FIG. 3, however, it can be seen that the supports 10, 12 (each made of a plastic molded part—see FIG. 3 *b*) have lateral bearing balls 16, which extend into bearing shells 38, and thus each form a joint bearing. This lateral orientation of the joint bearings allows a simple mountability by simultaneously snapping in both bearing balls of a ball support into the respective bearing shell. The web 28 (also as a plastic molded part—see FIG. 3 *b*) is mounted on the two hinge joints 32 which, however, here encompass the respective ball support in a fork-shape manner. Here, the pins of the hinge joints 32 penetrate perpendicular through plane parallel, planar outer surfaces 40 at the supports 10 and 12. The planar outer surfaces 40 at the support 10 and the support 12 lie at the planar insides 42 of the fork-shaped ends of the webs 28.

The bearing shells 38 into which the bearing balls 16 extend at upper ends of the supports 10, 12, are disposed according to FIG. 3 *b* in a plastic molded part 44 and similarly the bearing shells 38, into which the bearing balls 16 extend at the lower ends of the two supports 10 and 12. Thus, the (same) distance between the respective bearing shells 38 and between the hinge joints 16 can be determined precisely designed and tightly toleranced, namely in only one component in each case.

FIG. 3 *c* and *d* show an assembly (FIG. 3 *c* schematically and FIG. 3 *d* the physical design), which corresponds substantially completely to the assembly according to FIG. 3 *a* and *b* except for the reversal of the effective surfaces on the one hand in the joint bearings and on the other hand in the fork: in FIG. 3 *c* and *d*, at the hinge joint the ball support encompasses the web in a fork-shaped manner and not conversely, and the sockets (and not the balls) of the ball-socket joints are disposed at the ball support.

FIG. 6 shows two assemblies in physical design according to FIG. 3 *b* with the supports 8, 10, 12, 14 and the webs 28, how they support a receiving device 6 over a chassis 4. At this device 2, the receiving device 6 is rotationally driven above the chassis 4 by a motor 46 via a cam 20 in a through hole 24 in the receiving device 6. This device 2 is shown in FIG. 7 with a housing 47.

FIG. 4 shows a design of the joint bearings, which are formed by the bearing balls 16 and the bearing shells 38, as in FIG. 3 for example. As can be seen, the bearing shell 38 has three slits 48, which are uniformly distributed on the circumference of the edge 50 of the ball opening 52 of the bearing shell 38. A spring ring 54 on the outside around the bearing shell 38 tensions the walls of the bearing shell 38 inward against the bearing ball 16.

FIGS. 5 *a*, *b* and *c* show several schematic spatial views of alternative arrangement of the inventive ball supports of a device for mixing according to FIG. 1, in which the ball supports are connected together pairwise differently by webs.

The ball supports are represented highly schematically in FIG. 5 without socket, the chassis 4 and the receiving device 6 are each shown only highly schematically dotted as planes. In FIG. 5 *a* the rectangular arrangement of the four supports 8 to 14 is repeated—wherein however also the ball supports 10 and 12 as well as 8 and 14 are connected together by hinge joint-webs 56 or 58. FIG. 5 *b* shows a triangular arrangement of the three ball supports 8, 10 and 60—wherein only the ball supports 8 and 10 are connected together by the hinge joint-web 28. The third ball support 60 stands alone and supports the receiving device 6 on the chassis 4 in the manner of a three legs of a stool. FIG. 5 *c* finally shows a six-sided arrangement of six supports 8 to 14 and 62 and 64—wherein (as in FIG. 1) every two ball supports 8 and 10 are connected together by a hinge joint-web (28, 30 and 66).

The invention claimed is:

1. A mixing device comprising:

a chassis;

a receiving device for receiving mixtures and having a drive by means of which the receiving device is set in a mixing movement in a substantially horizontal plane relative to the chassis in which the receiving device moves on a closed path, periodically returning to a specific position in a specific alignment in space, and a bearing which guides the receiving device to reduce deviations from the horizontal plane in the mixing movement, wherein the bearing comprises:

at least two supports, each support having two bearing areas spaced apart from each other, the two bearing areas having substantially no translatory and at least two rotational degrees of freedom, wherein one bearing area of each support mounts the respective support to the chassis and the other bearing area mounts the receiving device to the respective support, and a guidance device which guides the rotation of the receiving device relative to the chassis during the mixing movement, wherein the guidance device has at least one web which connects two of the at least two supports, wherein a first and a second hinge joint, both having no translatory and only one rotational degree of freedom, mount the web between the at least two supports and the first and second hinge joints have axes parallel to each other and are rotatable around the axes.

2. The mixing device according to claim 1, wherein the bearing areas are joint bearings.

3. The mixing device according to claim 1, wherein the axes of the first and second hinge joints run centrally between the respective joint bearings of the two supports which are connected by the web and which are mounted at the chassis and at the receiving device by the respective joint bearings.

4. The mixing device according to claim 3, wherein at the positions of the hinge joints, the web encloses the support in a fork-like manner or the support encloses the web in a fork-like manner.

5. The mixing device according to claim 2, wherein the respective centers of rotation of the two joint bearings of one support are equidistant to the respective centers of rotation of the joint bearings of another support.

6. The mixing device according to claim 2, wherein the centers of rotation and/or the axes of rotation of two of the joint bearings mounting two of the respective supports at the chassis are equidistant to the centers of rotation and/or the axes of rotation of the joint bearings mounting the same respective supports at the receiving device.

7. The mixing device according to claim 1, wherein any weight acting on the receiving device is transferred to the chassis only by the supports and not by the drive.

8. The mixing device according to claim 1 further comprising a controllable thermostating or heating element selected from the group consisting of Peltier elements, resistive heating elements and heating films.

9. A method for mixing contents of laboratory vessels, comprising the steps of placing a laboratory vessel with contents on the mixing device according to claim 1, and then starting the mixing device.

10. The method according to claim 9, wherein the temperature of the contents of the laboratory vessel is changed via a thermostating or heating element.

11. The mixing device according to claim 2, wherein at least one of the joint bearings is selected from the group consisting of a universal joint, a ball joint, and a joint area with two bearings spaced apart from each other, each with only one rotational degree of freedom.

12. The mixing device according to claim 2, wherein the respective centers of rotation of the two joint bearings of one support are equidistant to the respective centers of rotation of the respective joint bearings of all supports.

13. The mixing device according to claim 2, wherein all centers of rotation and/or the axes of rotation of the joint bearings mounting their respective supports at the chassis are equidistant to the centers of rotation and/or the axes of rotation of the joint bearings mounting the same respective supports at the receiving device.

14. A mixing device for the contents of laboratory vessels comprising:

a chassis;

a receiving device for receiving the laboratory vessels for mixing and having a drive by means of which the receiving device is set in a mixing movement in a substantially horizontal plane relative to the chassis in which the receiving device moves on a closed path, periodically returning to a specific position in a specific alignment in space, one or more laboratory vessels to be held by the receiving device and whose contents are to be mixed by the mixing device, and a bearing which guides the receiving device in the mixing movement to reduce deviations from the horizontal plane, wherein the bearing comprises:

at least two supports, each support having two bearing areas spaced apart from each other, the two bearing areas having substantially no translatory and at least two rotational degrees of freedom, wherein one bearing area of each support mounts the respective support to the chassis and the other bearing area mounts the receiving device to the respective support, and a guidance device which guides the rotation of the receiving device relative to the chassis during the mixing movement, wherein the guidance device has at least one web which connects two of the at least two supports, wherein a first and a second hinge joint, both having no translatory and only one rotational degree of freedom, mount the web between the at least two supports and the first and second hinge joints have axes parallel to each other and are rotatable around the axes.

15. The mixing device according to claim 14, wherein the axes of the first and second hinge joints run centrally between the respective joint bearings of the two supports which are connected by the web and which are mounted at the chassis and at the receiving device by the respective joint bearings.

16. The mixing device according to claim 15, wherein at the positions of the hinge joints, the web encloses the support in a fork-like manner or the support encloses the web in a fork-like manner.

* * * * *